US010099087B2

(12) United States Patent
Truesdell et al.

(10) Patent No.: US 10,099,087 B2
(45) Date of Patent: Oct. 16, 2018

(54) CAM ASSEMBLY FOR USE WITH POLE CLIMBING FALL RESTRICTION DEVICE

(71) Applicant: Buckingham Manufacturing Company, Inc., Binghamton, NY (US)

(72) Inventors: Kevin W. Truesdell, Binghamton, NY (US); Timothy Batty, Binghamton, NY (US); James J. Rullo, Binghamton, NY (US); DeForest C. Canfield, Oxford, NY (US)

(73) Assignee: Buckingham Manufacturing Company, Inc., Binghamton, NY (US)

( * ) Notice: Subject to any disclaimer, the term of this patent is extended or adjusted under 35 U.S.C. 154(b) by 77 days.

(21) Appl. No.: 15/137,079

(22) Filed: Apr. 25, 2016

(65) Prior Publication Data

US 2016/0310793 A1 Oct. 27, 2016

Related U.S. Application Data

(60) Provisional application No. 62/152,085, filed on Apr. 24, 2015.

(51) Int. Cl.

| | |
|---|---|
| ***A63B 27/00*** | (2006.01) |
| ***A62B 35/00*** | (2006.01) |
| *A63B 29/00* | (2006.01) |

(52) U.S. Cl.

CPC ..... *A63B 27/00* (2013.01); *A62B 35/0075* (2013.01); *A63B 29/00* (2013.01)

(58) Field of Classification Search

CPC ..... A63B 27/00; A63B 27/02; A63B 27/04; A62B 35/0075; A62B 35/0037; A62B 35/0043; A62B 35/0081; A62B 35/0087; A62B 1/14; A44B 11/00; A44B 11/12; Y10T 24/4016

See application file for complete search history.

(56) References Cited

U.S. PATENT DOCUMENTS

| | | | | | |
|---|---|---|---|---|---|
| 318,053 | A * | 5/1885 | Thurlow | A44B 11/12 | 24/170 |
| 2,998,626 | A * | 9/1961 | Prete, Jr. | A44B 11/14 | 24/170 |
| 3,179,994 | A * | 4/1965 | Meyer | A62B 1/14 | 182/3 |
| 3,348,632 | A * | 10/1967 | Swager | A62B 35/04 | 182/230 |

(Continued)

FOREIGN PATENT DOCUMENTS

WO 2010012989 2/2010

OTHER PUBLICATIONS

Canadian Office Action application No. 2,928,081 dated Dec. 18, 2017 pp. 1-4.

*Primary Examiner* — Colleen M Chavchavadze
*Assistant Examiner* — Shiref M Mekhaeil
(74) *Attorney, Agent, or Firm* — Bond Schoeneck & King, PLLC; Frederick Price; George McGuire

(57) ABSTRACT

In a pole climbing fall prevention assembly having a pole strap, lanyard, and cam assembly that permits adjustment of the pole strap, a lever is attached to the sidewall of a cam assembly to ease the task of a climber needing to adjust the pole strap. A second lever can be attached to the second sidewall of the cam assembly to provide easier access to the lever regardless of the orientation of the cam assembly relative to the climber.

18 Claims, 7 Drawing Sheets

(56) References Cited

U.S. PATENT DOCUMENTS 4,034,828 A * 7/1977 Rose ..... A62B 1/14 182/5
4,059,871 A * 11/1977 Swager ..... A62B 1/14 182/5
4,077,094 A * 3/1978 Swager ..... A62B 1/14 182/5
4,113,298 A * 9/1978 Kopp ..... B66C 1/48 267/158
4,174,119 A * 11/1979 Biles ..... B60P 7/12 24/68 CD
4,253,218 A * 3/1981 Gibbs ..... A62B 1/14 182/5
4,366,757 A * 1/1983 Funk ..... B61D 7/18 105/248
4,546,851 A * 10/1985 Brennan ..... A62B 35/0075 182/7
4,715,567 A * 12/1987 Poccard ..... B64C 9/16 244/129.1
5,146,655 A * 9/1992 Gibbs ..... A44B 99/00 188/65.2
5,271,127 A * 12/1993 Christensen ..... B60P 7/0823 24/16 R
5,593,009 A * 1/1997 King ..... A45C 5/14 190/102
5,638,919 A * 6/1997 Pejout ..... A62B 1/14 182/192
5,661,877 A * 9/1997 Bloomer ..... A44B 11/12 24/170
5,745,959 A * 5/1998 Dodge ..... A43C 11/00 24/68 SK
5,762,401 A * 6/1998 Bernard ..... B60N 2/366 296/63
5,924,522 A * 7/1999 Ostrobrod ..... A62B 1/14 182/191
6,056,086 A * 5/2000 Gortan ..... A62B 1/14 182/197
6,086,131 A * 7/2000 Bingle ..... E05B 83/26 292/336.3
6,386,588 B1 * 5/2002 Young ..... A44B 11/12 280/821
6,665,913 B2 * 12/2003 Kosh ..... A44B 11/12 24/170
6,802,442 B1 * 10/2004 Thompson ..... A44B 11/14 224/259
6,868,587 B2 * 3/2005 Rard ..... A44B 11/125 24/170
7,086,122 B2 * 8/2006 Livingston ..... A43C 11/1406 24/68 SK
7,131,675 B1 * 11/2006 Loucks ..... F24B 15/002 294/10
8,225,905 B2 * 7/2012 Delaittre ..... A62B 1/14 182/190
8,544,603 B1 * 10/2013 Rullo ..... A62B 35/00 182/9
9,155,359 B1 * 10/2015 Bailey ..... A44B 11/065
9,622,547 B2 * 4/2017 Seader ..... B60P 7/0823
2004/0103480 A1 * 6/2004 Carlson-Smith ..... A47G 21/00 7/112
2005/0115367 A1 * 6/2005 Williams ..... B25B 13/5058 81/151
2005/0205356 A1 * 9/2005 Velasco, Jr. ..... A62B 35/0037 182/3
2009/0188753 A1 * 7/2009 Liang ..... A63B 27/00 182/133
2010/0089694 A1 * 4/2010 Paul ..... A63B 27/00 182/9
2012/0317761 A1 * 12/2012 Tardif ..... F16B 45/02 24/599.5
2012/0317762 A1 * 12/2012 Tardif ..... F16B 45/02 24/601.5
2013/0104354 A1 * 5/2013 Miller ..... B60P 7/0823 24/68 CD
2014/0026373 A1 * 1/2014 Seader ..... A44B 11/12 24/193
2014/0251725 A1 * 9/2014 Schurian ..... A62B 35/0025 182/3
2016/0213961 A1 * 7/2016 Anderson ..... A62B 35/0075
2016/0258457 A1 * 9/2016 Moine ..... F16B 2/06
2016/0287914 A1 * 10/2016 Hwang ..... A62B 35/0068
2017/0050055 A1 * 2/2017 Spydell, Jr. ..... A62B 1/14
2017/0182928 A1 * 6/2017 Seader ..... B60P 7/0869
2017/0205012 A1 * 7/2017 Nyfelt ..... E21B 33/038

* cited by examiner

CAM ASSEMBLY FOR USE WITH POLE CLIMBING FALL RESTRICTION DEVICE

REFERENCE TO RELATED APPLICATION

The present application relates and claims priority to U.S. Provisional Application Ser. No. 62/152,085, filed Apr. 24, 2015, the entirety of which is hereby incorporated by reference.

BACKGROUND

1. Field of Invention

The present invention relates generally to pole climbing equipment, and more particular to assemblies that assist in preventing a person from falling while ascending or descending a pole.

2. Background of Art

Pole fall restriction devices are well known in the art. The assemblies typically comprise a pole strap that is adapted to wrap around the pole, a front strap or lanyard that connects to both the pole strap and the user's body harness and wraps around the front of the pole nearest the user, and adjustment hardware for adjusting the effective length of the pole strap and lanyard. When a user begins ascending or descending a pole, he or she will grab a hold of the pole strap near one end, while making any necessary adjustments to the effective length of the straps with the other hand. When actually ascending or descending, the user will hold the ends of the pole strap and move it up or down while hitchhiking up or down the pole.

To adjust the length of the pole strap wrapped around the pole, the climber manipulates a spring-biased cam. When in its neutral condition, the cam securely grips and retains the webbing from which the pole strap is composed. To alter the effective length of the pole strap, the climber must manually overcome the spring-bias of the cam such that it no longer engages the webbing, thereby permitting the webbing to slide freely through the cam. Once the desired alteration to the effective length of the webbing is achieved, the climber can release the cam thus permitting the bias of the spring to forcibly close the cam into securely engaged relation with the webbing.

While the spring biased cam is an effective tool for adjusting the pole strap, its manipulation by a climber is not easy. The climber is suspended above the ground, supported only by a harness and the fall prevention assembly. While having to hold the pole strap with one hand, the other hand is then used to overcome the spring bias and then slide the pole strap to the desired position. The simultaneous manipulation of several items, while suspended and balancing oneself relative to a pole requires ample training and skill.

OBJECTS AND ADVANTAGES

It is therefore a principal object and advantage of the present invention to provide a cam assembly that includes levers to assist the climber in overcoming the spring bias and adjust the pole strap.

Other objects and advantages will in part be obvious and in part appear hereinafter.

SUMMARY OF THE INVENTION

In accordance with the foregoing object and advantage, one aspect of the present invention provides a cam assembly for use with a pole climbing fall prevention assembly. The pole climbing fall prevention assembly comprises a pole strap and a lanyard. The cam assembly comprises a body having a base and opposing sidewalls; a cam pivotally connected to the body; a spring attached to the cam and producing a bias force thereto relative to the body; and a lever attached to one of the opposing sidewalls. A connector interconnects the cam assembly to the lanyard.

In another aspect of the invention a second lever is attached to the other of the opposing sidewalls.

In another aspect of the invention, the first and second levers are coated or covered with a non-slip material.

In another aspect of the invention, the non-slip material is preferably brightly colored so as to serve as a source of visual distinction making it easier to see and grab.

In another aspect of the invention directional indicators are applied to/printed upon either or both of the first and second levers.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
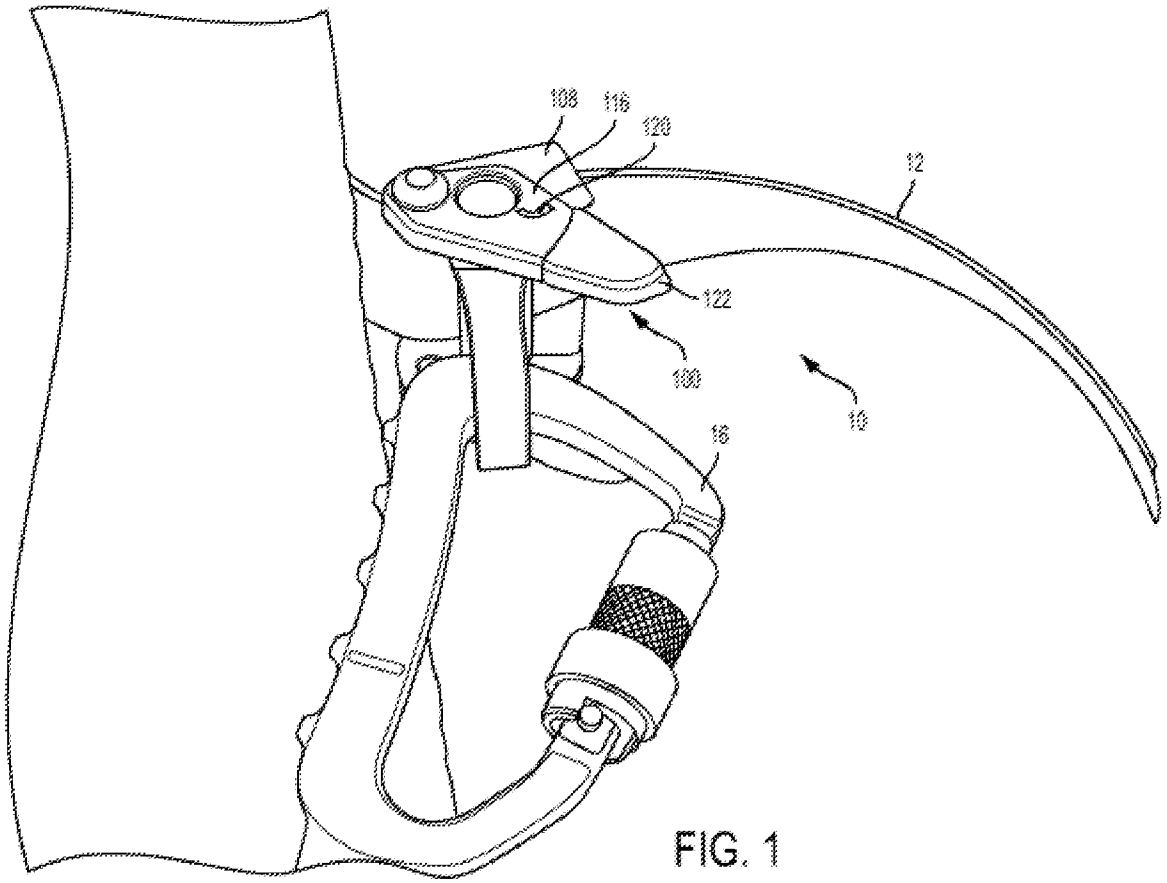
FIG. 1 is close-up perspective view of an embodiment of the present invention in use with a pole strap and lanyard connecting carabineer.
Figure 2:
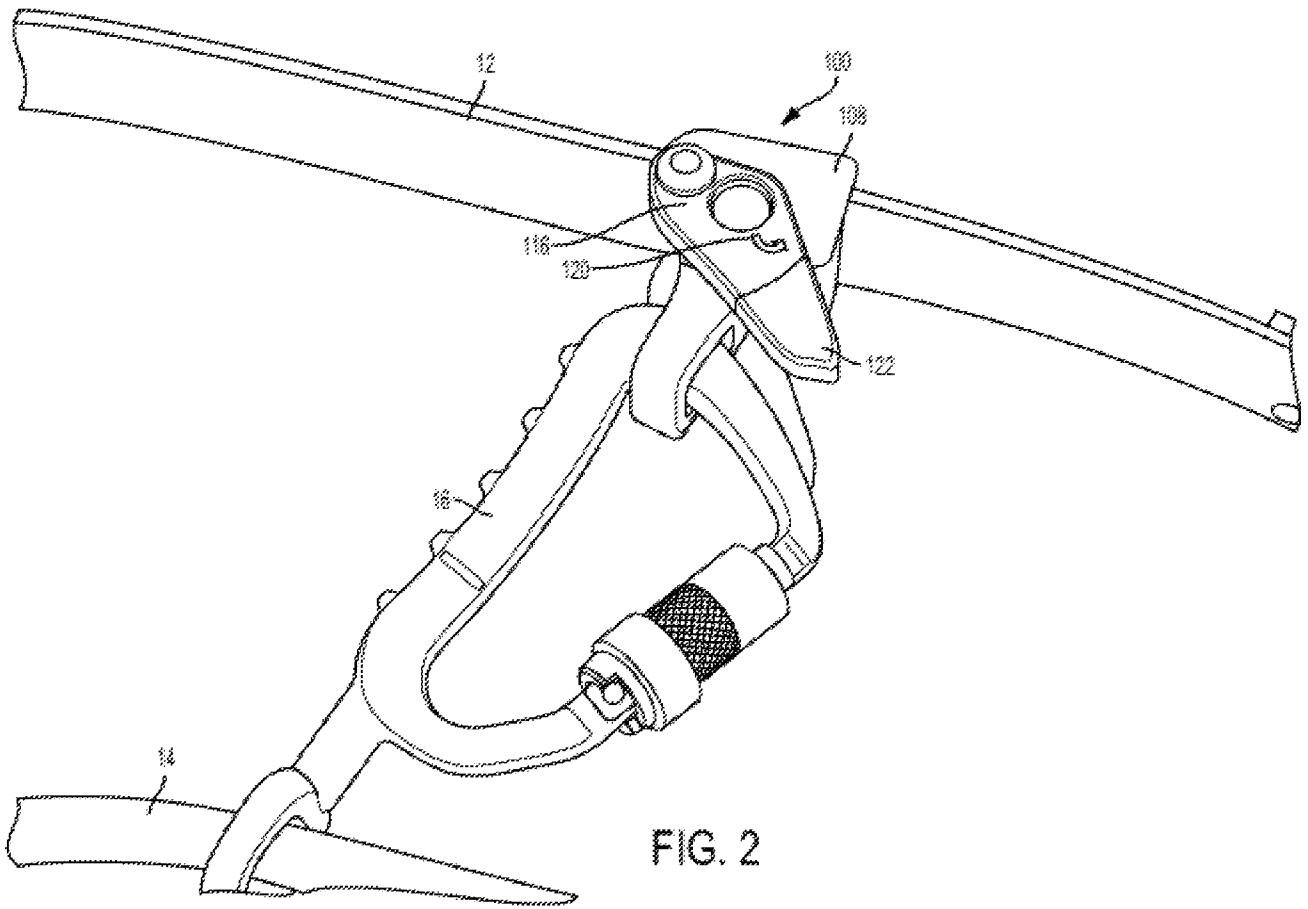
FIG. 2 is a top plan view of an embodiment of the present invention assembled with a pole strap and lanyard connecting carabineer.
Figure 3:
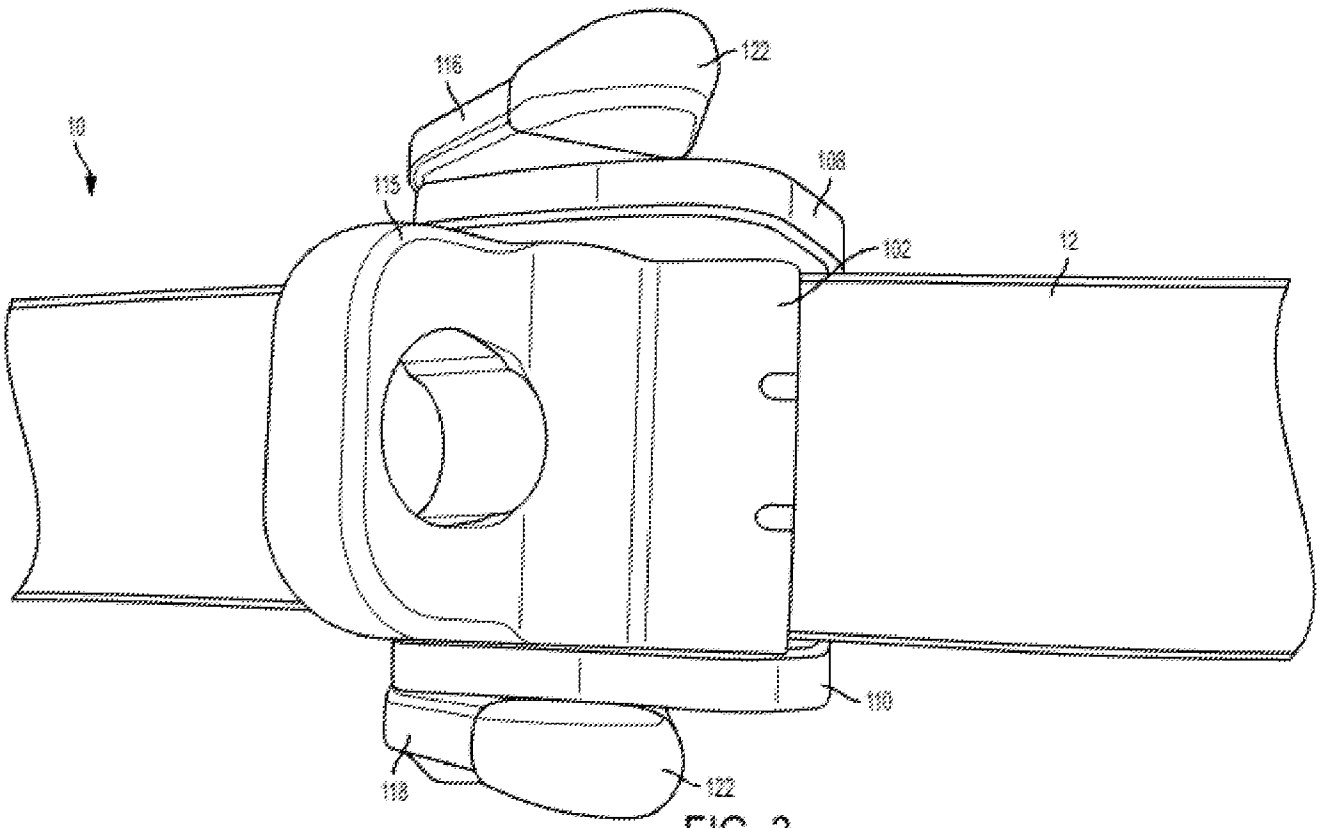
FIG. 3 is a top plan view of an embodiment of the present invention assembled on a pole strap.
Figure 4:
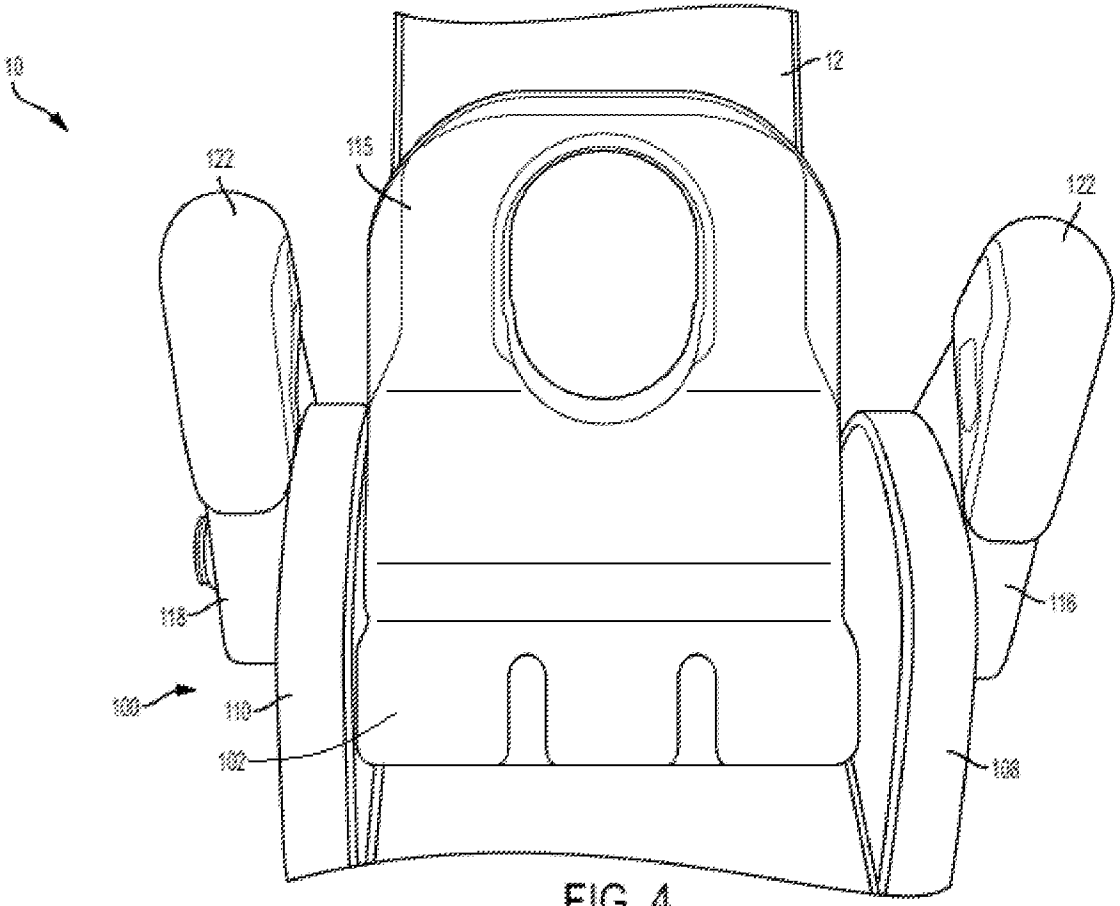
FIG. 4 is a front elevation view of an embodiment of the present invention assembled on a pole strap.
Figure 5:
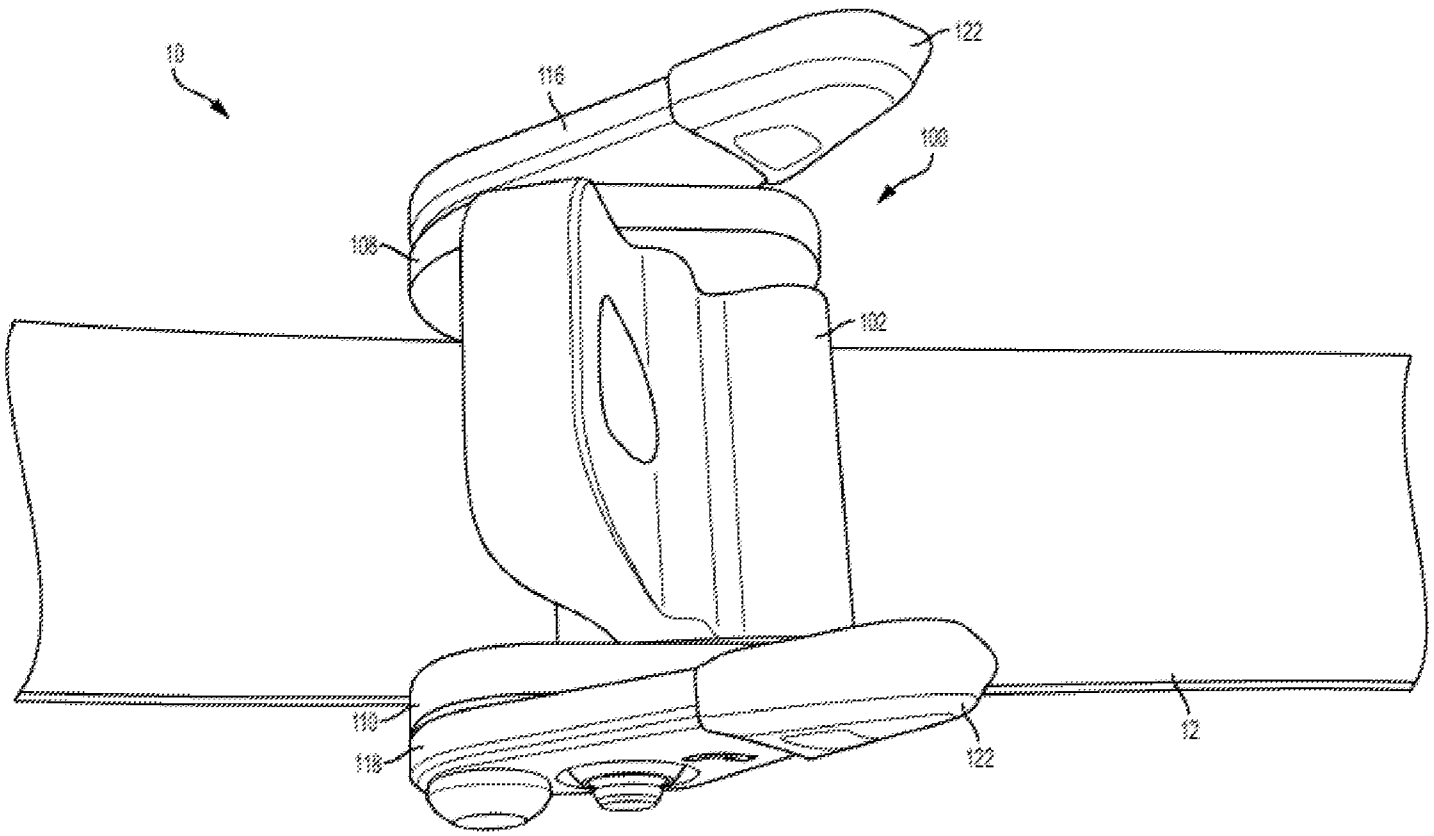
FIG. 5 is another top plan view of an embodiment of the present invention assembled on a pole strap.
Figure 6:
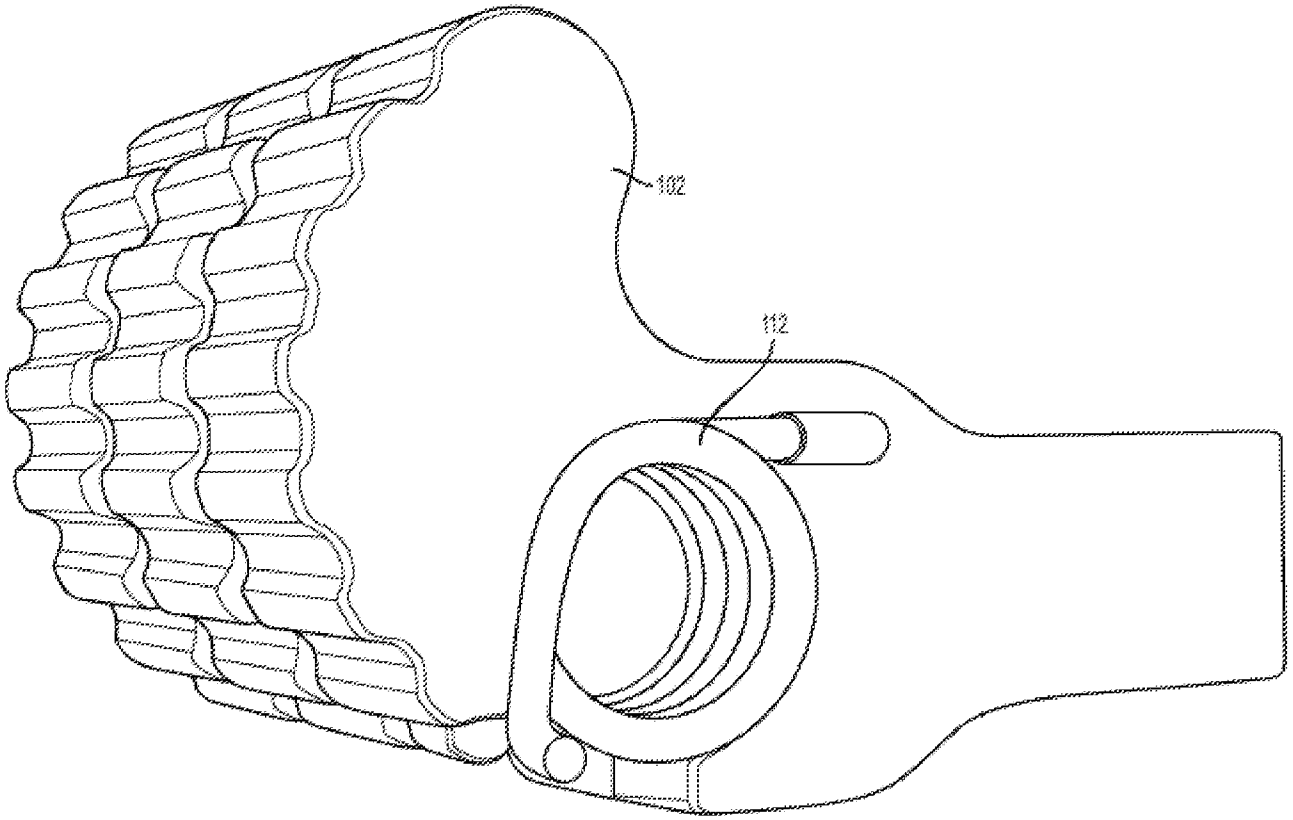
FIG. 6 is a perspective view of a spring and cam assembly.
Figure 7:
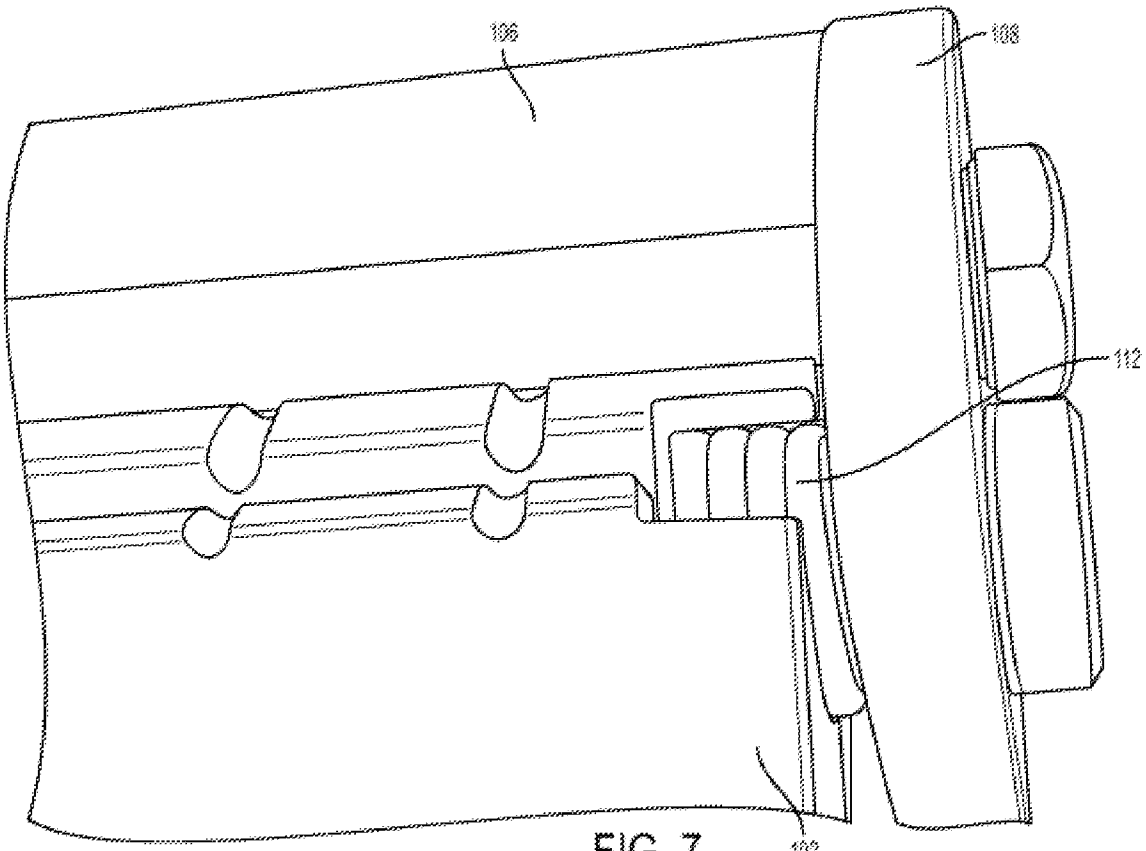
FIG. 7 is a perspective view of a spring and cam assembled with the body of the cam assembly.

Referring now to the drawings, in which like reference numerals refer to like parts throughout, there is seen in FIG. 1 a pole climbing fall prevention assembly designated generally by reference numeral 10, comprising a pole strap 12, a lanyard 14 (see FIG. 2), a cam assembly, designated generally by reference numeral 100, through which pole strap 12 passes and is connected, and a connector (e.g., carabineer) 16 interconnecting cam assembly 100 to lanyard 14. Pole strap 12 is composed of a length of webbing (made of nylon, leather or other pliable but durable material).

Cam assembly 100 will be referred to hereinafter as a "web grab" as that is indicative of the function it serves (i.e., grabbing a web of material). Web grab 100 comprises a cam 102 pivotally connected to a base 106, and a pair of opposed sidewalls 108/110 formed on opposite sides of base 106. Cam 102 connects to base 106 by a spring 112 that is coiled within cam 102 and bolt 114 that passes through sidewall 108 and spring 112 and serves as the pivot axis for cam 102 relative to housing 104. Spring 112 naturally biases cam 102 into engaged relation with base 106; in order to separate cam 102 from base 106, thereby creating a space through which pole strap 12 can pass, one must manually overcome the spring force and pivot cam 102 away from base 106. Once the manually applied force is removed, spring 112 will bias cam 102 back into engaged relation with base 106—or pole strap 12 (assuming it is passed between cam 102 and base 106). When pole strap 12 is passed between cam 102 and base 106, cam 102 will secure the positioning of pole strap 102 in place until the bias of spring 112 is manually overcome, thereby permitting the pole strap to be moved/adjusted relative to web grab 100.

Web grab 100 is connected to lanyard 14 by connector 16. Connector 16 is removably attached to cam 102 by passing the leg of connector 16 through an eyelet 115 formed through cam 102. Connector 16 also includes an eye 18 through which lanyard 14 passes. The weight of a climber to whom the lanyard 14 is tethered creates a pulling force that causes cam 102 to remain securely engaged with pole strap 12. To adjust pole strap 12 the climber must permit some slack to be formed in lanyard 16.

To assist a climber with overcoming the spring bias, web grab 100 further comprises a pair of levers 116/118 securely attached to sidewalls 108/110, respectively, by bolts or other conventional fastening means. A directional indicator 120 is printed on levers 116/118 to assist the climber in immediately knowing which way to move the lever in order to overcome the spring bias and cause separation between cam 102 and pole strap 12. Web grab 100 could be equipped with only a single lever instead of two, but providing the two levers permits either side of the web grab 100 to be accessed depending on the orientation of web grab 100 relative to the climber. Levers 116/118 extend outwardly away from web grab 100 to provide a moment arm that minimizes the amount of force needed to be applied to the lever in order to overcome the spring bias. In addition, a non-slip, brightly colored covering 122 is applied over the ends of levers 116/118 to make it both more comfortable and easier for the climber to see and use.

What is claimed is:

1. A cam assembly for use with a pole climbing fall restriction device that comprises a pole strap and a lanyard, said cam assembly comprising:

a) a body having a base and opposing, first and second sidewalls;

b) a cam pivotally connected to said body;

c) a spring attached to said cam and producing a bias force thereto relative to said body; and d) a first and a second lever attached to said first and second sidewalls respectively;

e) wherein said first and second levers are attached and positioned on opposite outermost surfaces of the cam assembly.

2. The cam assembly according to claim 1, further comprising first and second non-slip coverings positioned over said first and second levers, respectively.

3. The cam assembly according to claim 2, wherein each of said first and second non-slip coverings are brightly colored to provide a source of visual distinction.

4. The cam assembly according to claim 1, further comprising a directional indicator applied to at least one of said first lever or second levers or combinations thereof.

5. The cam assembly according to claim 1, further comprising a first non-slip covering positioned over said first lever.

6. The cam assembly according to claim 5, wherein said first non-slip covering is brightly colored to provide a source of visual distinction.

7. The cam assembly according to claim 1, further comprising a directional indicator applied to said first lever.

8. A pole fall restriction assembly, comprising:

a) an elongated pole strap; and b) a cam assembly attached to said elongated pole strap and comprising:

i) a body having a base and opposing, first and second sidewalls;

ii) a cam pivotally connected to said body;

iii) a spring attached to said cam and producing a bias force thereto relative to said body; and iv) a first and a second lever attached to said first and second sidewalls respectively;

v) wherein said first and second levers are attached and positioned on opposite outermost surfaces of the cam assembly.

9. The pole fall restriction assembly of claim 8, further comprising an elongated lanyard.

10. The pole fall restriction assembly of claim 9, wherein said cam assembly further comprises an eyelet formed through said cam.

11. The pole fall restriction assembly of claim 10, further comprising a connector interconnecting said cam assembly to said elongated lanyard.

12. The pole fall restriction assembly of claim 11, wherein said connector passes through said eyelet.

13. The pole fall restriction assembly of claim 8, further comprising first and second non-slip coverings positioned over said first and second levers, respectively.

14. The pole fall restriction assembly of claim 13, wherein each of said first and second non-slip coverings are brightly colored to provide a source of visual distinction.

15. The pole fall restriction assembly of claim 8, further comprising a directional indicator applied to at least one of said first lever and or second levers or combinations thereof.

16. The pole fall restriction assembly of claim 8, further comprising a first non-slip covering positioned over said first lever.

17. The pole fall restriction assembly of claim 16, wherein said first non-slip covering is brightly colored to provide a source of visual distinction.

18. The pole fall restriction assembly of claim 8, further comprising a directional indicator applied to said first lever.

* * * * *